US009284801B2

(12) United States Patent
Maguire et al.

(10) Patent No.: US 9,284,801 B2
(45) Date of Patent: Mar. 15, 2016

(54) ACTUATOR SWITCH FOR A DOWNHOLE TOOL, TOOL AND METHOD

(71) Applicant: PACKERS PLUS ENERGY SERVICES INC., Calgary (CA)

(72) Inventors: Patrick Glen Maguire, Cypress, TX (US); Fernando Olguin, Houston, TX (US); Robert Joe Coon, Missouri City, TX (US)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 415 days.

(21) Appl. No.: 13/874,237

(22) Filed: Apr. 30, 2013

(65) Prior Publication Data

US 2013/0306328 A1 Nov. 21, 2013

Related U.S. Application Data

(60) Provisional application No. 61/641,157, filed on May 1, 2012.

(51) Int. Cl.

| | |
|---|---|
| ***E21B 33/00*** | (2006.01) |
| ***E21B 23/00*** | (2006.01) |
| ***E21B 23/04*** | (2006.01) |
| ***E21B 23/06*** | (2006.01) |
| ***E21B 33/128*** | (2006.01) |
| ***E21B 41/00*** | (2006.01) |

(52) U.S. Cl.
CPC ..... *E21B 23/00* (2013.01); *E21B 23/04* (2013.01); *E21B 23/06* (2013.01); *E21B 33/1285* (2013.01); *E21B 41/00* (2013.01)

(58) Field of Classification Search
CPC ..... E21B 33/1285
See application file for complete search history.

(56) References Cited

U.S. PATENT DOCUMENTS

| | | | | |
|---|---|---|---|---|
| 6,568,470 | B2 | 5/2003 | Goodson, Jr. et al. | |
| 6,926,089 | B2 | 8/2005 | Goodson, Jr. et al. | |
| 7,012,545 | B2 | 3/2006 | Skinner et al. | |
| 7,428,922 | B2 | 9/2008 | Fripp et al. | |
| 8,016,026 | B2 | 9/2011 | Joseph | |
| 2003/0019622 | A1 * | 1/2003 | Goodson, Jr. ..... | E21B 23/04 166/66.5 |
| 2009/0025928 | A1 | 1/2009 | Lee | |

* cited by examiner

*Primary Examiner* — Kenneth L Thompson
*Assistant Examiner* — Steven MacDonald
(74) *Attorney, Agent, or Firm* — Bennett Jones LLP

(57) ABSTRACT

An actuator switch for actuation of a downhole tool, the actuator switch comprising: a rheomagnetic fluid having a state convertible between a liquid and a solid by the application of a magnetic field thereto, a change in the state of the rheomagnetic fluid acting to actuate the downhole tool; and a magnet installed in the tool and moveable relative to the rheomagnetic fluid to apply or remove the magnetic field to the rheomagnetic fluid, the magnet being moved by through tubing operations in an inner diameter of the downhole tool.

28 Claims, 2 Drawing Sheets

ACTUATOR SWITCH FOR A DOWNHOLE TOOL, TOOL AND METHOD

FIELD

The invention relates to apparatus and methods for wellbore tools and, in particular, to a wellbore method and apparatus and apparatus for actuation of a downhole tool.

BACKGROUND

Downhole tools, used in wellbore operations, may require actuation downhole. Because of the distance from surface and downhole rigors, reliable actuation of downhole tools is often difficult.

"Controllable fluids" are materials that respond to an applied electric or magnetic field with a change in their rheological behavior. Typically, this change is manifested when the fluids are sheared by the development of a yield stress that is more or less proportional to the magnitude of the applied field. These materials are commonly referred to as electrorheological or rheomagnetic (also known as magnetorheological) fluids. Interest in controllable fluids derives from their ability to provide simple, quiet, rapid-response interfaces between electronic controls and mechanical systems. Controllable fluids have the potential to radically change the way electromechanical devices are designed and operated.

Rheomagnetic fluids are suspensions of magnetically responsive, polarizable particles having a size on the order of a few microns in a carrier fluid. Typical carrier fluids for magnetically responsive particles include hydrocarbon oil, silicon oil and water. The particles in the carrier fluid may represent 25-45% of the total mixture volume. Such fluids respond to an applied magnetic field with a change in rheological behavior. Polarization induced in the suspended particles by application of an external field causes the particles to form columnar structures parallel to the applied field. These chain-like structures restrict the motion of the fluid, thereby increasing the viscous characteristics of the suspension.

SUMMARY

In accordance with a broad aspect of the present invention, there is provided an actuator switch for actuation of a downhole tool, the actuator switch comprising: a rheomagnetic fluid having a state convertible between a liquid and a solid by the application of a magnetic field thereto, a change in the state of the rheomagnetic fluid acting to actuate the downhole tool; and a magnet installed in the tool and moveable relative to the rheomagnetic fluid to apply or remove the magnetic field to the rheomagnetic fluid, the magnet being moved by through tubing operations in an inner diameter of the downhole tool.

In accordance with another broad aspect of the present invention, there is provided a downhole tool for a wellbore operation, the downhole tool comprising: a wall defining an inner diameter and an outer surface; an operation mechanism for the downhole tool; and an actuator switch for actuating the operation mechanism, the actuator switch including: a chamber containing rheomagnetic fluid, the rheomagnetic fluid having a state convertible between a liquid and a solid by the application of a magnetic field thereto, a change in the state of the rheomagnetic fluid acting to actuate the downhole tool; and a magnet installed in the inner diameter and moveable relative to the rheomagnetic fluid to apply or remove the magnetic field to the rheomagnetic fluid, the magnet being moved by through tubing operations in the inner diameter of the downhole tool.

In accordance with another broad aspect of the present invention, there is provided a method for actuating a wellbore tool in a wellbore, the method comprising: running a tubing string with a wellbore tool therein into a wellbore to a desired position in the wellbore; and manipulating a magnet by a through tubing operation to move the magnet relative to a switch mechanism for the downhole tool to cause a phase change in rheomagnetic fluid of the switch between a solid and a liquid to actuate the downhole tool.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION

Figure 1A:
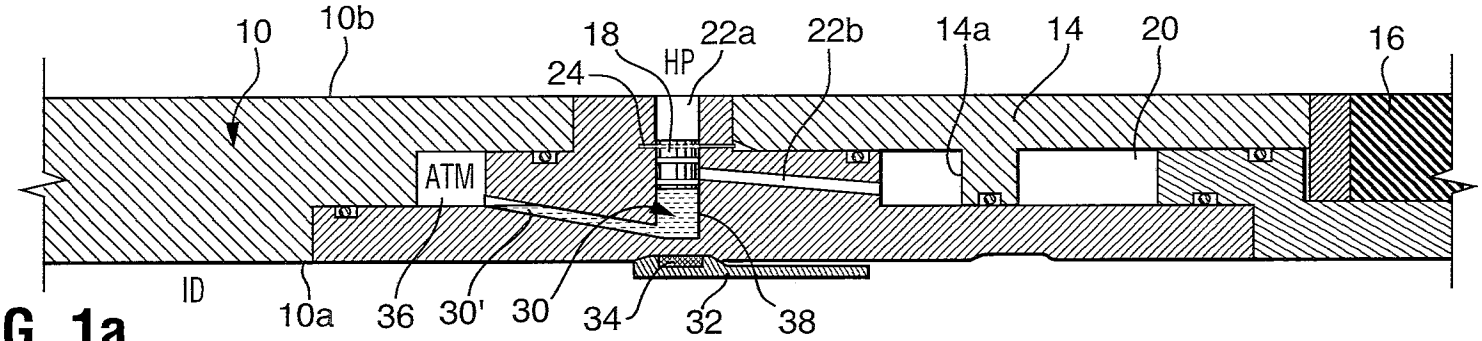
FIGS. 1*a* to 1*c* are sectional views through a wall of a downhole tool with a switch installed therein.

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number is used to reference similar, but not necessarily identical, parts.

An actuator switch for controlling a downhole tool, a downhole tool and a method have been invented.

The actuator switch described herein is for actuation of a downhole tool and controls actuation of the tool and in particular the tool's operation mechanism, for example, to permit operation, to drive a mechanism, etc. For example, the actuator switch may actuate the tool's opening, setting, movement, etc. The tool operation mechanism to be actuated by the switch can include components to open, set or otherwise operate the tool.

The actuator switch employs rheomagnetic fluid, which is a suspension of magnetic particles in a carrier fluid, such as oil. When the fluid is subjected to a magnetic field, the fluid greatly increases in its apparent viscosity, to the point of becoming a viscoelastic solid. Thus the fluid can be actuated from a liquid to a solid by exposure to a magnetic field. In some embodiments, the strength of the solid can be controlled by the strength of the magnetic field used.

The operation of the switch can be by a through tubing operation, which is an operation in the inner diameter of the tool. The inner diameter of the tool is in communication with surface operations through the inner diameter of the tubing string in which the tool is installed. Through tubing operations include tool intervention or hydraulically by applied pressure. In one embodiment, the switch operation can be accomplished hydraulically without the need to communicate pressure from within the tubing to components of the switch or the actuating mechanism external to the tubing. Thus, a portless sub body can be employed for the downhole tool. A portless sub body is one having no fluid communication directly through the wall, for example no port or opening through the body wall, from the tubing inner diameter to the tool operation mechanism. Without this port or opening through the body wall, a leak point is avoided and tool operation mechanisms are isolated from pressure cycling in the inner diameter. For example, when the tubing is pressurized, for example, during wellbore fluid treatment operations, the tool operation mechanism is not subjected to the pressurization, which decreases the chances of a pressure-based breach or malfunction.

Two versions of the switch have been invented: one operating in response to an intervention signal and another operating in response to an applied pressure signal. The switches each have a receiver for receiving the signal. Intervention, herein, refers to an application of physical force to the receiver to cause movement.

While some switches may employ electrical or electronic components, this switch in some embodiments can be devoid of such components and, therefore, does not require a power source installed in the tool or electrical or electronic communications from surface.

The switch can be applied for example to various downhole tools. In a packer, for example, the tool operation mechanism is a setting mechanism controlled by the switch.

Figure 1B:
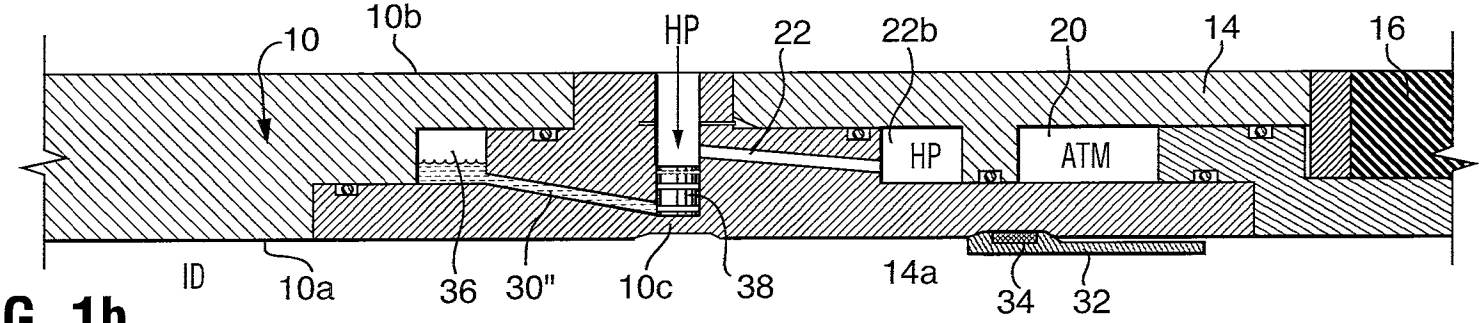
Figure 1C:
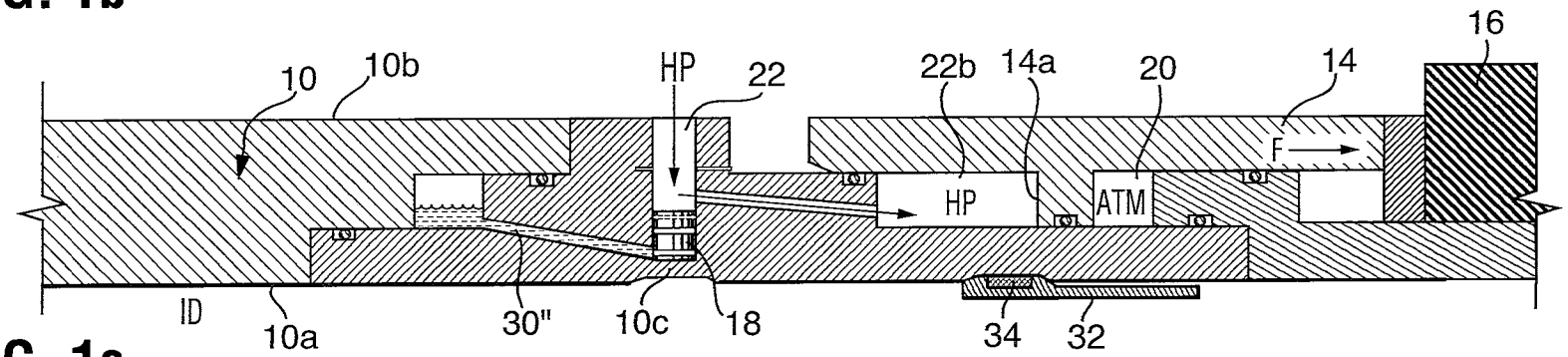

With reference to FIGS. 1*a* to 1*c*, sectional views through a wall 10 of a wellbore packer are shown. Wall 10 forms the body of the packer and includes inner wall surface 10*a* and outer surface 10*b*. Wall 10 separates an inner diameter ID of the packer from an annular area the tool, when it is installed in a wellbore. The packer is set using a setting sleeve 14 that compresses a packer element 16 to extrude it out. When the packer is unset, as shown in FIG. 1*a*, packer setting sleeve 14 is in an unset position and does not apply a compressive force to element 16. However, packer-setting sleeve 14 may be driven against element by exposing a piston face 14*a* of setting sleeve 14 to hydrostatic fluid pressure HP, which is the pressure of that fluid in the annulus open to outer surface 10*b*.

The packer remains unset until actuated to set by the actuator switch. In this embodiment, for example, piston face 14*a* remains isolated from hydrostatic pressure until actuator switch allows an inflow of hydrostatic pressure into contact with face 14*a*.

An actuator switch is employed in the packer to actuate setting of the packer. The actuator switch includes a switch mechanism and a receiver. The switch mechanism employs a piston 18 and rheomagnetic fluid 30.

In the unset position, a piston 18 normally separates the hydrostatic fluid from an atmospheric chamber 20 of the setting sleeve. Piston 18 plugs a port 22 that extends from outer surface 10*b* to piston face 14*a*. When piston 18 is in place in the port, hydrostatic pressure HP cannot be communicated through port 22 to piston face 14*a*. However, as shown in FIG. 1*b*, if piston 18 is removed (i.e. including moved out of the way), hydrostatic fluid can be communicated through to piston face 14*a*, as shown in FIG. 1*c*.

Piston 18 separates port 22 such that one end 22*a* of port is open to outer surface 10*b* and the other end 22*b* of port forms a chamber exposed to piston face. The pressure ATM in port end 22*b* may be balanced with the pressure ATM in chamber 20 across the piston face 14*a*.

Piston 18 is normally held in a plugging position in port 22 by rheomagnetic fluid 30. The rheomagnetic fluid when in the presence of a magnetic field acts like a solid 30', not a fluid. The switch mechanism takes advantage of the rheomagnetic fluid's properties to change state from solid 30' to liquid 30" when the magnetic field is removed. Piston 18 can also held by a releasable holding mechanism such as a shear pin 24, but control is primarily through the state of fluid. Even if there is force enough to shear pin 24, if fluid 30 is in the solid state, the piston cannot move.

The switch receiver accepts the signal, usually as controlled from surface, to change the state of the rheomagnetic fluid. In this version of the switch, the receiver is a collet 32 on the ID of the packer wall. Collet 32 carries a magnet 34 and collet 32 is positioned to place the magnetic field from magnet 34 on the rheomagnetic fluid, keeping the piston in place. The position of magnet 34, and therefore collet 32, determines the state of the fluid. Movement of collet 32 can be used to vary the magnetic field applied to the rheomagnetic fluid.

A force applied thereto moves collet 32. The force could be a flow from the surface, intervention tools or pressure that act on a piston formed in the ID to move the collet. For example, the collet could be moved by running in with a string, engaging the collet and applying a force to move the collet. Alternately, the collet could be moved by generating a pressure differential across it to move the collet to the low-pressure side. One option for this is to include a seat on the collet to catch a plug such that a piston can be formed across the collet.

Once the collet is moved, the magnetic field generated by magnet 34 is moved away from the rheomagnetic fluid. The fluid then changes state to a liquid 30". Because the fluid in the liquid state has no holding properties, this releases the fluid to be pushed out of the way by piston 18. Liquid state fluid 30" can move into a chamber 36. Chamber 36 can accommodate an atmospheric, lower pressure so that liquid 30" and piston can move without a pressure lock. In the illustrated embodiment, movement of piston 18 also requires that shear pin 24 is overcome, and, thus, hydrostatic must be greater than the holding force of pin 24. Piston 18 is now pushed out of port 22, into a side pocket 38 open to chamber 36, allowing hydrostatic pressure arrows HP to enter the end 22*b* of the port and into contact with piston face 14*a* of the setting sleeve.

As shown in FIG. 1*c*, once hydrostatic pressure contacts piston face 14*a*, setting sleeve 14 is driven, arrow F, against element 16 to set the packer.

Figure 2A:
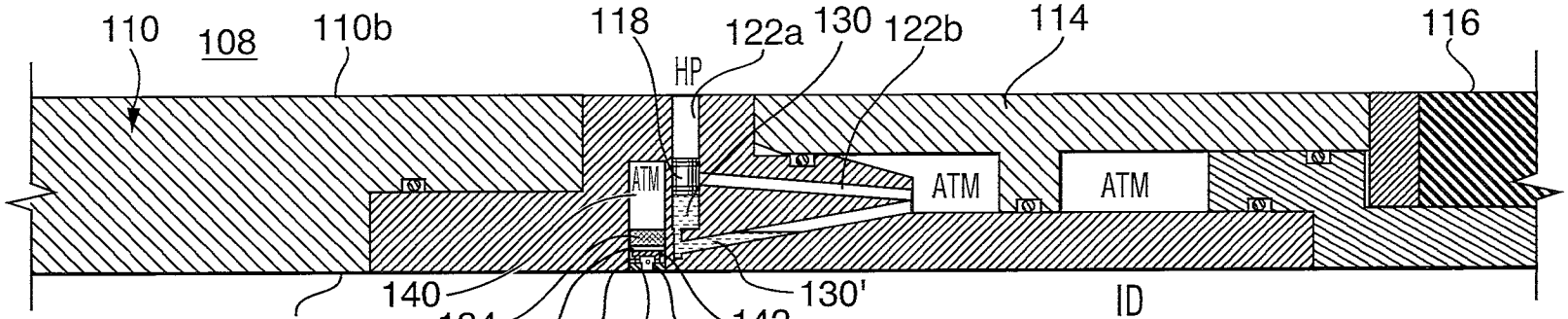
FIGS. 2*a* to 2*c* are sectional views through a wall of a downhole tool with a switch installed therein.
Figure 2B:
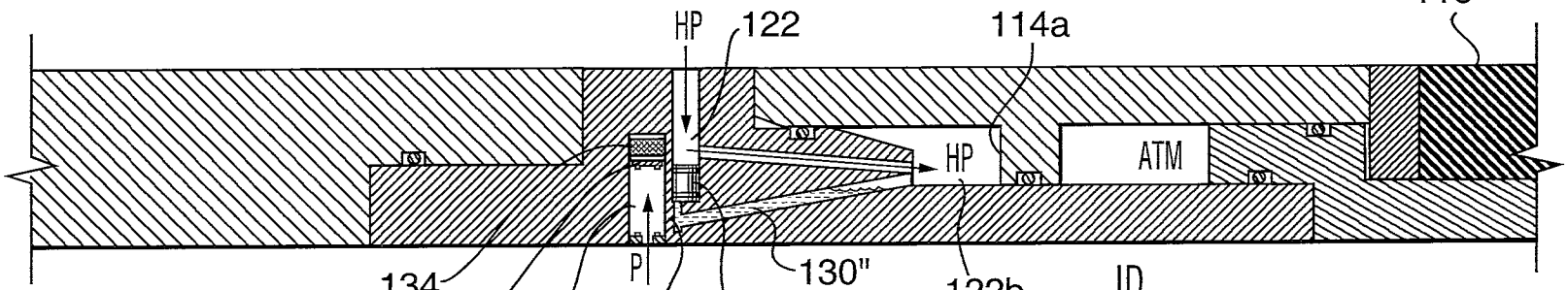
Figure 2C:
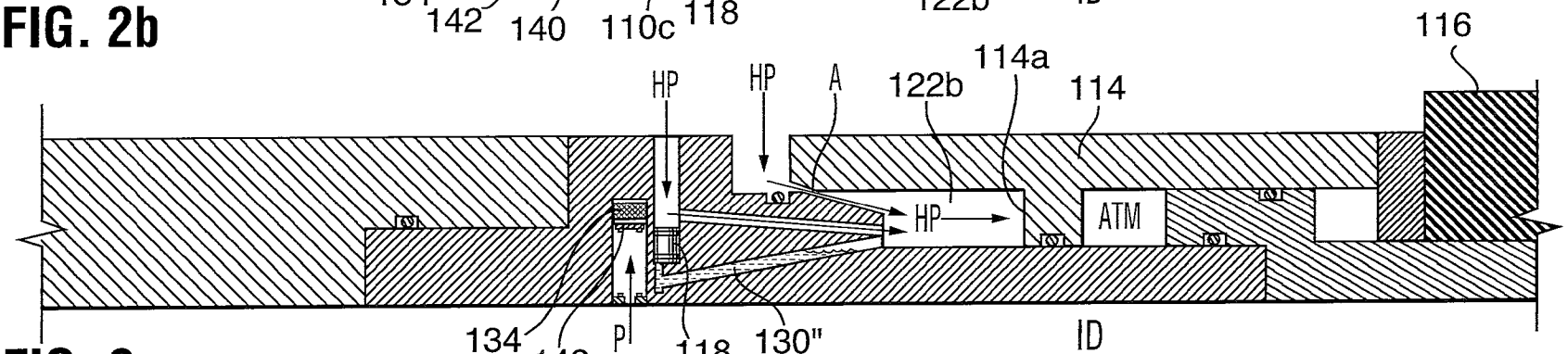

With reference to FIGS. 2*a* to 2*c*, another tool 108 with a rheomagnetic actuation switch is shown. In this embodiment, a piston 118 separates the hydrostatic pressure HP from atmospheric chamber 122*b* adjacent piston face 114*a*. The magnetic field acting on rheomagnetic fluid 130 is supplied by a magnet 134 in a chamber 140 close to, for example parallel to, the setting piston 118. Chamber 140 has an open end 140*a* in pressure communication with the inner diameter ID defined by inner facing surface 110*a* of the tool body 110, but the chamber does not pass through the thickness of the body so it does not create any possible leak path through the tool body wall from inner facing surface 110*a* to outer surface 110*b*. The magnet 134 is installed in the chamber on a piston body 142 by a threaded-in plug 144 that is attached to the magnet by a shear connection 146.

A seal 148 on piston body 142 pressure isolates a low pressure, atmospheric end ATM of chamber 140 from opening 140*a*.

By applying tubing pressure P through the ID of tool body 110, the piston body 142 on which magnet 134 is carried breaks at shear connection 146 from plug 144. Tubing pressure P causes the magnet 134 to move, thereby moving the magnetic force generated by magnet 134 away from the rheomagnetic fluid 130 in the adjacent setting piston chamber 136. This changes the phase of the rheomagnetic fluid to a liquid 130" from a solid 130'. Because the rheomagnetic fluid is now flowable, as a liquid, the fluid is pushed out of the way of piston and, in this embodiment, into atmospheric chamber 122 (FIG. 2*b*). The movement of piston 118 from the initial position blocking port 122 (FIG. 2*a*) to the final position opening port 122 (FIG. 2*b*) allows hydrostatic pressure to flood into the setting chamber 122*b*, arrows HP, and into contact with piston face 114*a*. This pushes the setting sleeve 114 to compress and extrude element 116.

In this embodiment, as shown in FIG. 2*c*, the movement of the setting sleeve 114 opens at A the setting chamber 122*b* to the hydrostatic chamber thus accelerating setting of the packer element 116.

In these tools, the tool body portion (10*c* in FIGS. 1*a* and 100*c* in FIG. 2*a*) between the magnet and the rheomagnetic fluid is selected to allow the magnetic field to pass therethrough. For example, the tool body portion can be formed of material devoid of iron such as for example Inconel, monel, etc.

While the magnets are each positioned in the tubing inner diameter, such they are driven by processes through the inner diameter (tool manipulation or hydraulics), the magnets may be isolated from fluids of the tubing inner diameter such that they don't tend to magnetically attract and retain metal debris. For example, magnet may be internal to the collet, protected between a backside of the collet and inner facing side 10*a* of the wall and magnet 134 is protected within the chamber 140.

These tools may be employed in a method for actuating a wellbore tool in a wellbore. The tools may be formed to be connected into a tubing string with their inner diameters ID connected into the tubing inner bore. The method includes: running a tubing string with a tool therein into a wellbore to a desired position in the wellbore, which places the outer surface of the tool into communication with the hydrostatic pressure of the well. Thereafter, the method includes moving a magnet relative to a switch for the tool to cause a phase change in rheomagnetic fluid of the switch between liquid and solid to actuate the tool. A noted above, the magnet can be moved by through tubing operations, wherein the magnet is moved by hydraulic pressure actuation or tool engagement and manipulation.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. An actuator switch for actuation of a downhole tool, the actuator switch comprising:

a rheomagnetic fluid having a state convertible between a liquid and a solid by the application of a magnetic field thereto, a change in the state of the rheomagnetic fluid acting to actuate the downhole tool; and a magnet installed in the tool and moveable relative to the rheomagnetic fluid to apply or remove the magnetic field to the rheomagnetic fluid, the magnet being moved by through tubing operations in an inner diameter of the downhole tool.

2. The actuator switch of claim 1, further comprising a piston exposed to the inner diameter and the magnet is carried by the piston and moveable by a pressure differential established across the piston.

3. The actuator switch of claim 1, further comprising a mechanism exposed to the inner diameter and the magnet is carried by the mechanism and moveable by engagement by an intervention tool in the inner diameter of the downhole tool.

4. The actuator switch of claim 1 wherein the rheomagnetic fluid is maintained between a setting chamber and a source of fluid pressure and the change in state of the rheomagnetic fluid permits a pressure of the source of fluid pressure to be communicated to the setting chamber to actuate the tool.

5. The actuator switch of claim 4 including a piston between the rheomagnetic fluid and the source of fluid pressure.

6. The actuator switch of claim 1 devoid of electrical or electronic components.

7. The actuator switch of claim 1 wherein the magnet is protected from contact with fluids in the inner diameter.

8. A downhole tool for a wellbore operation, the downhole tool comprising:

a wall defining an inner diameter and an outer surface;

an operation mechanism for the downhole tool; and an actuator switch for actuating the operation mechanism, the actuator switch including: a chamber containing rheomagnetic fluid, the rheomagnetic fluid having a state convertible between a liquid and a solid by the application of a magnetic field thereto, a change in the state of the rheomagnetic fluid acting to actuate the downhole tool; and a magnet installed in the inner diameter and moveable relative to the rheomagnetic fluid to apply or remove the magnetic field to the rheomagnetic fluid, the magnet being moved by through tubing operations in the inner diameter of the downhole tool.

9. The downhole tool of claim 8 wherein the operation mechanism is a drive mechanism for tool opening, setting or movement.

10. The downhole tool of claim 8 further comprising a packing element and the operation mechanism is a setting sleeve for compressing the packing element to extrude outwardly.

11. The downhole tool of claim 8 wherein the wall is portless between the inner diameter and operation mechanism.

12. The downhole tool of claim 8 further comprising a receiver in the inner diameter for receiving a signal to initiate movement of the magnet.

13. The downhole tool of claim 12 wherein the receiver carries the magnet.

14. The downhole tool of claim 12 wherein the receiver responds to an application of physical force applied through the inner diameter.

15. The downhole tool of claim 12 wherein the receiver responds to hydraulic pressure.

16. The downhole tool of claim 12, wherein the receiver includes a piston exposed to the inner diameter and the magnet is carried by the piston and moveable by a pressure differential established across the piston.

17. The downhole tool of claim 12 wherein the receiver includes a mechanism exposed to the inner diameter and the magnet is carried by the mechanism and moveable by engagement by an intervention tool in the inner diameter.

18. The downhole tool of claim 8 wherein the rheomagnetic fluid is maintained between a setting chamber for the operation mechanism and a source of fluid pressure and the change in the state of the rheomagnetic fluid permits a pressure of the source of fluid pressure to be communicated to the setting chamber to actuate the tool.

19. The downhole tool of claim 18 including a piston between the rheomagnetic fluid and the source of fluid pressure.

20. The downhole tool of claim 8 wherein the magnet is protected from contact with fluids in the inner diameter.

21. The downhole tool of claim 8 wherein the actuator switch is devoid of electrical and electronic components.

22. The downhole tool of claim 8 wherein the actuator switch operates without a power source and without electrical or electronic communications from surface.

23. A method for actuating a wellbore tool in a wellbore, the method comprising:

running a tubing string with a wellbore tool therein into a wellbore to a desired position in the wellbore; and manipulating a magnet by a through tubing operation to move the magnet relative to a switch mechanism for the downhole tool to cause a phase change in rheomagnetic fluid of the switch between a solid and a liquid to actuate the downhole tool.

24. The method of claim 23 wherein the magnet is positioned within the inner diameter of the wellbore tool and manipulating includes engaging the magnet and moving the magnet by physical application of force.

25. The method of claim 23 wherein the magnet is positioned within the inner diameter of the wellbore tool and manipulating includes applying hydraulic pressure to the inner diameter moving the magnet by application of hydraulic pressure.

26. The method of claim 23 wherein the magnet is positioned on a piston and manipulating includes applying hydraulic pressure to the inner diameter to generate a pressure differential across the piston to move the magnet.

27. The method of claim 23 wherein actuating the downhole tool includes exposing an operation mechanism of the downhole tool to hydrostatic pressure.

28. The method of claim 27 wherein the rheomagnetic fluid is maintained between a setting chamber for the operation mechanism and hydrostatic pressure and the phase change permits hydrostatic pressure to be communicated to the setting chamber to actuate the downhole tool.

* * * * *